US006471323B2

(12) United States Patent
Shibata et al.

(10) Patent No.: US 6,471,323 B2
(45) Date of Patent: Oct. 29, 2002

(54) INK JET PRINTING METHOD AND APPARATUS

(75) Inventors: Tsuyoshi Shibata, Kanagawa (JP); Noribumi Koitabashi, Kanagawa (JP); Masataka Yashima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/941,777

(22) Filed: Aug. 30, 2001

(65) Prior Publication Data

US 2002/0054179 A1 May 9, 2002

(30) Foreign Application Priority Data

Sep. 1, 2000 (JP) ..... 2000-266158

(51) Int. Cl.[7] ..... B41J 2/205; B41J 29/38
(52) U.S. Cl. ..... 347/15; 43/14; 43/98
(58) Field of Search ..... 347/43, 15, 14, 347/19, 16, 98, 100, 47

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/57 |
| 4,740,796 A | | 4/1988 | Endo et al. | 347/56 |
| 5,898,443 A | | 4/1999 | Yoshino et al. | 347/19 |
| 6,139,127 A | * | 10/2000 | Kato et al. | 347/15 |
| 6,164,773 A | * | 12/2000 | Oikawa | 347/100 |

FOREIGN PATENT DOCUMENTS

| | | |
|---|---|---|
| EP | 0 699 535 A2 | 3/1996 |
| EP | 0 726 156 A1 | 8/1996 |
| JP | 59-123670 | 7/1984 |
| JP | 59-138461 | 8/1984 |

* cited by examiner

*Primary Examiner*—Lamson Nguyen
(74) *Attorney, Agent, or Firm*—Fitzpatrick, Cella, Harper & Scinto

(57) ABSTRACT

An ink jet printing method and apparatus using a color ink and a print performance improving ink which minimizes an image quality degradation due to blank lines formed by failed or faulty nozzles. This system enables the use of a print head even with failed or faulty nozzles by minimizing the image quality degradation and extends the life of the print head before replacement. The print performance improving ink is not ejected and landed near a blank line, thus allowing the color ink dots near the blank line to spread and thereby making the blank line undistinguishable.

11 Claims, 14 Drawing Sheets

1ST PASS

2ND PASS

NON-EJECTING NOZZLE LINE

NON-EJECTING NOZZLE LINE

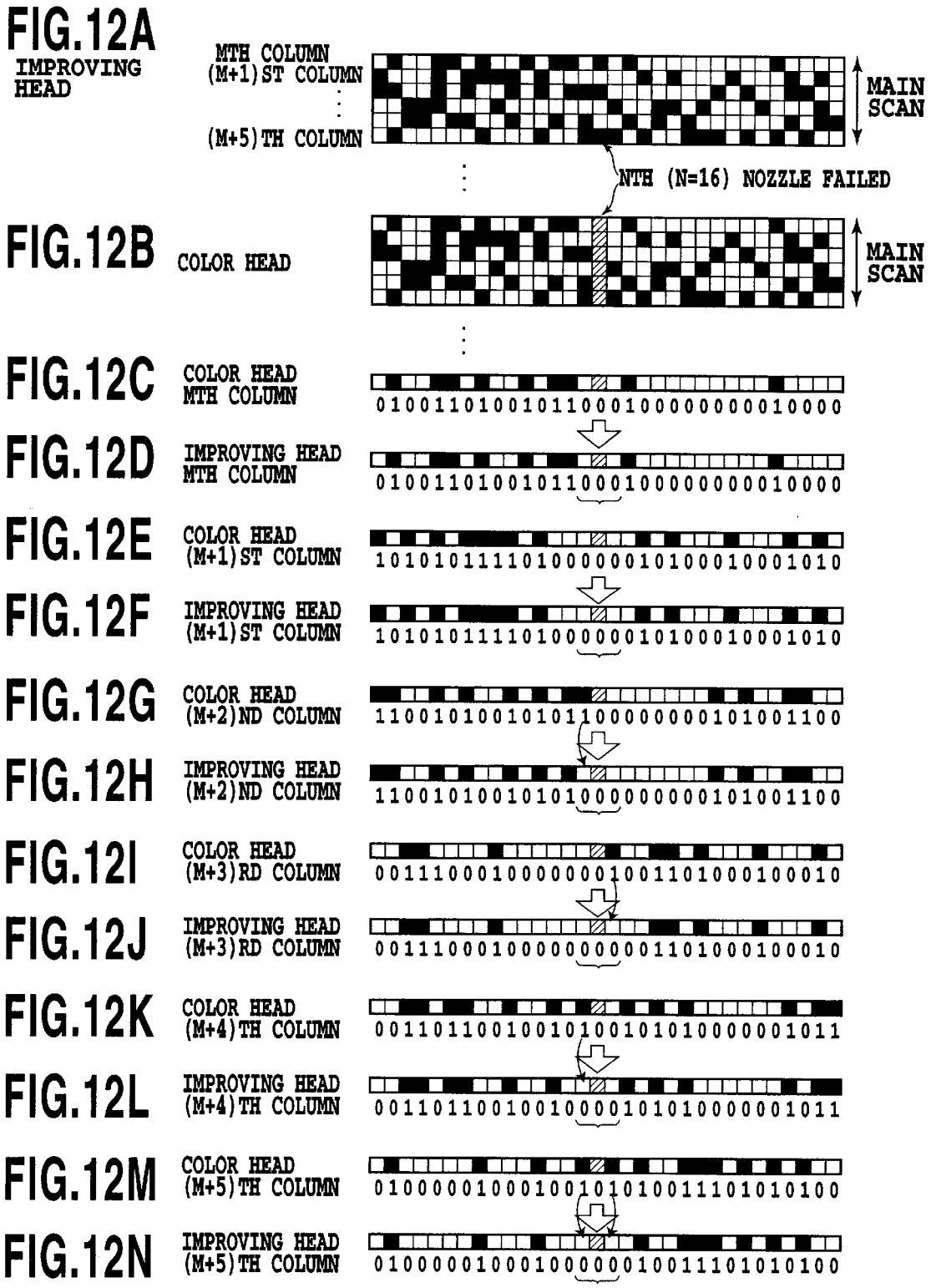
FIG.12A
IMPROVING HEAD
MTH COLUMN
(M+1)ST COLUMN
(M+5)TH COLUMN
MAIN SCAN
NTH (N=16) NOZZLE FAILED
FIG.12B
COLOR HEAD
MAIN SCAN
FIG.12C
COLOR HEAD MTH COLUMN
0100110100101100010000000000010000
FIG.12D
IMPROVING HEAD MTH COLUMN
0100110100101100010000000000010000
FIG.12E
COLOR HEAD (M+1)ST COLUMN
1010101111010000001010001000101 0
FIG.12F
IMPROVING HEAD (M+1)ST COLUMN
1010101111010000001010001000101 0
FIG.12G
COLOR HEAD (M+2)ND COLUMN
1100101001010110000000010100110 0
FIG.12H
IMPROVING HEAD (M+2)ND COLUMN
1100101001010100000000010100110 0
FIG.12I
COLOR HEAD (M+3)RD COLUMN
0011100010000000100110100010 0 10
FIG.12J
IMPROVING HEAD (M+3)RD COLUMN
0011100010000000000110100010 0 10
FIG.12K
COLOR HEAD (M+4)TH COLUMN
0011011001001010010101000000 1011
FIG.12L
IMPROVING HEAD (M+4)TH COLUMN
0011011001001000010101000000 1011
FIG.12M
COLOR HEAD (M+5)TH COLUMN
0100000100010010101001110101 0100
FIG.12N
IMPROVING HEAD (M+5)TH COLUMN
0100000100010000001001110101 0100

FIG.14A COLOR HEAD MTH COLUMN
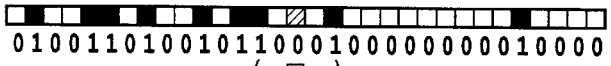
FIG.14B IMPROVING HEAD MTH COLUMN
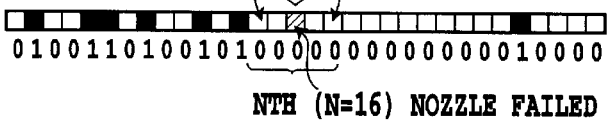
FIG.14C COLOR HEAD (M+1)ST COLUMN
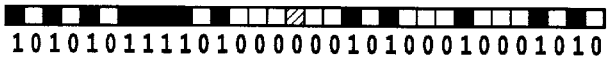
FIG.14D IMPROVING HEAD (M+1)ST COLUMN
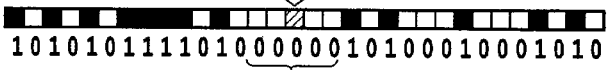
FIG.14E COLOR HEAD (M+2)ND COLUMN
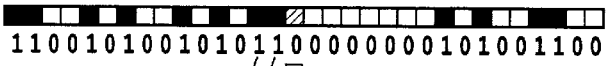
FIG.14F IMPROVING HEAD (M+2)ND COLUMN
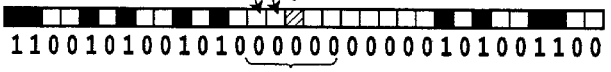
FIG.14G COLOR HEAD (M+3)RD COLUMN
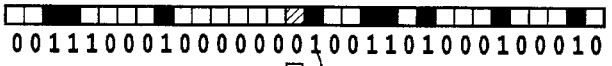
FIG.14H IMPROVING HEAD (M+3)RD COLUMN
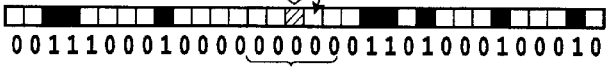
FIG.14I COLOR HEAD (M+4)TH COLUMN
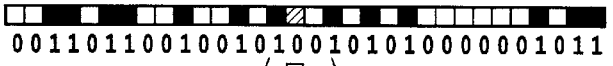
FIG.14J IMPROVING HEAD (M+4)TH COLUMN
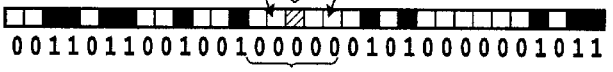
FIG.14K COLOR HEAD (M+5)TH COLUMN
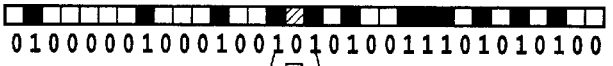
FIG.14L IMPROVING HEAD (M+5)TH COLUMN
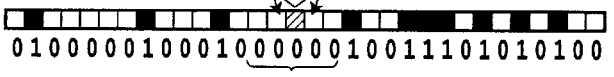

INK JET PRINTING METHOD AND APPARATUS

This application is based on Patent Application No. 2000-266158 filed Sep. 1, 2000 in Japan, the content of which is incorporated hereinto by reference.

BACKGROUND OF THE INVENTION

1. Field of the Invention

The present invention relates to an ink jet printing method and apparatus which uses a print head having an array of ink nozzles formed therein, color inks containing colorants and a liquid for improving a print performance (hereinafter referred to as a print performance improving ink) and prints an image on a print medium. The present invention is applicable to all apparatus using print media including paper, cloth, leather, non-woven fabric, OHP sheets and even metals. Examples of applicable apparatus include office equipment such as printers, copying machines and facsimiles and industrial production equipment.

2. Description of the Related Art

As the spread of copying machines, information processing devices such as word processors and computers, and communication devices, ink jet printing apparatus as output devices for these equipment to record images have come into increasingly widespread use.

In an ink jet printing apparatus described above, a print head has a plurality of ink nozzles arrayed therein and also a plurality of ink ejection ports and ink passages integrally formed therein to improve a printing speed. In recent years, two or more print heads are used to deal with color printing.

The ink jet printing system ejects droplets of ink or print liquid onto a print medium such as paper to form ink dots on the medium. Because it is of non-contact type, its noise level is low. An increased density of nozzles can enhance the resolution and printing speed, and high quality images can be produced with low cost without requiring special processing such as development and fixing even on such print mediums as plain paper. Because of these advantages, the ink jet printing apparatus is finding a widening range of applications.

An on-demand type ink jet printing apparatus in particular can easily cope with color printing and a printing apparatus body itself can be reduced in size and simplified. Therefore, the on-demand type ink jet printing apparatus is expected to capture a wide range of demands in the future. As the color printing becomes more widespread, there are increasing demands for a higher image quality and a faster printing speed.

In such an ink jet printing system, a technique has been proposed which uses a print performance improving ink capable of improving the condition of color dots on a print medium to enhance an image quality. The print performance improving ink is a colorless or light-colored liquid containing a compound that makes colorants in color inks insoluble. When mixed and/or reacted with color inks on a print medium, the print performance improving ink improves water resistance and weatherability of color dots to produce a highly reliable image quality and at the same time reduces feathering or bleeding between different colors to provide a high quality with high print density.

The conventional ink jet printing apparatus, however, has the following problems even when the print performance improving ink is used.

Where a print head with a plurality of ink nozzles arrayed therein is used, if one or more nozzles are clogged or cannot be driven for some reason, ink cannot be ejected from these nozzles, failing to print dots that need to be printed on the print medium. This results in blank lines being formed on an image extending in a main scan direction, significantly degrading the image quality.

Further, when the print head has faulty nozzles whose ejection conditions greatly differ from those of normal nozzles, a blank line or some form of line due to uneven densities is generated on an image, also degrading the image quality substantially.

Such lines become conspicuous when a multipass printing is not performed or when the number of passes during the multipass printing is small.

To deal with this problem, in the event that there are non-ejecting nozzles or faulty nozzles, it has been a common practice to use a nozzle cleaning mechanism to recover the ejection performance of the non-ejecting or faulty nozzles. When a multipass printing is performed in which one complete printed line is produced by a plurality of passes, a conventional practice has been to replace the non-ejecting or faulty nozzles with complementary nozzles.

The multipass printing system, however, has a drawback that because the paper is fed by $1/n$ the nozzles used and data which is complementarily culled to $1/n$ is printed n times during the main scan to print one raster line with a plurality (n) of nozzles, the printing time takes that much longer. The cleaning for recovering the printing performance has a drawback of taking time and causing a cost increase due to consumption of ink. Simply replacing a print head having non-ejecting or faulty nozzles is not desirable in terms of ecology.

What is required of a future ink jet printing apparatus is to realize a faster printing speed and a reduced cost while at the same time enhancing an image quality.

SUMMARY OF THE INVENTION

The present invention has been accomplished in light of the problems described above and it is an object in solving these problems to provide an ink jet printing method and apparatus which, even when there are abnormal (non-ejecting or faulty) nozzles, can print an image with simple processing that has smooth gradations without any image quality degradations including blank lines.

According to one aspect of the present invention to achieve the above objective, the ink jet printing method comprises the steps of: using a color ink print head and a print performance improving ink print head, the color ink print head having a plurality of ink ejection ports arrayed therein, the print performance improving ink print head having a plurality of ink ejection ports arrayed therein; and ejecting a color ink from the color ink print head and a print performance improving ink from the print performance improving ink print head onto a print medium to form an image on the print medium according to input image data; wherein, in forming an image on the print medium, the print performance improving ink is not applied to a dot position corresponding to an abnormal ink ejection port among the plurality of ink ejection ports in the color ink print head which is determined to have a deteriorated ejection state, and to a vicinity of the dot position corresponding to the abnormal ink ejection port.

For example, the print performance improving ink is not applied to a print line corresponding to an abnormal ink ejection port and to at least one line each immediately before and after the print line.

According to another aspect of the invention, the ink jet printing apparatus comprises: a color ink print head having a plurality of ink ejection ports arrayed therein to eject a color ink; a print performance improving ink print head having a plurality of ink ejection ports arrayed therein to eject a print performance improving ink; a means for identifying from among the plurality of ink ejection ports in the color ink print head an abnormal ink ejection port determined to have a deteriorated ejection state; and a control means for not applying the print performance improving ink to a dot position corresponding to the identified abnormal ink ejection port and to a vicinity of the dot position corresponding to the abnormal ink ejection port; wherein the color ink and the print performance improving ink are ejected from these print heads onto a print medium to form an image on the print medium according to input image data.

Because this invention does not apply the print performance improving ink to dot positions corresponding to failed and faulty nozzles and to a vicinity of these dot positions, it is possible to greatly reduce unwanted blank lines in the printed image with simple processing even when some of the nozzles in the color ink head fail or become faulty. Hence, a high quality image can be formed. Further, the ink head with a failed nozzle, or a non-ejecting nozzle, can be used for a long period of time without having to be replaced, which is desirable in terms of ecology.

The above and other objects, effects, features and advantages of the present invention will become more apparent from the following description of embodiments thereof taken in conjunction with the accompanying drawings.

BRIEF DESCRIPTION OF THE DRAWINGS

FIGS. 12A to 12N are diagrams showing print data of a color ink and a print performance improving ink before and after the correction processing according to the second embodiment of the invention;

FIGS. 14A to 14L are diagrams showing print data of a color ink and a print performance improving ink before and after the correction processing according to the third embodiment of the invention.

DETAILED DESCRIPTION OF PREFERRED EMBODIMENTS

Now, embodiments of the present invention will be described in detail by referring to the accompanying drawings.

Figure 1:
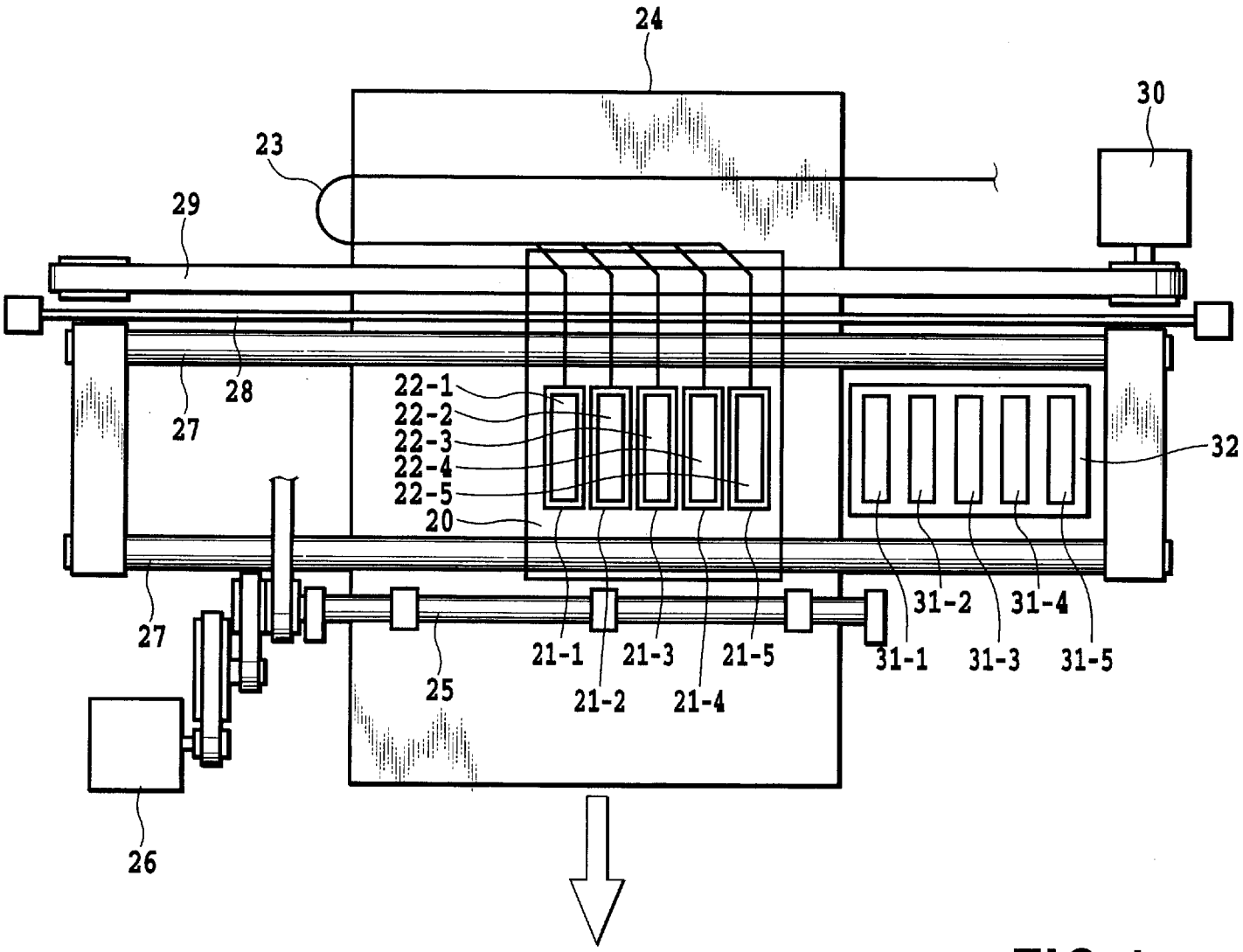
FIG. 1 is a plan view showing a schematic construction of an ink jet printing apparatus as one embodiment of the present invention.

FIG. 1 is a plan view showing a schematic construction of one embodiment of an ink jet printing apparatus according to the present invention.

In FIG. 1, a plurality of ink jet heads (print heads) 21-1 to 21-5 are mounted on a carriage 20. Each ink jet head 21, as shown in FIG. 2, has arrayed therein a plurality of ink ejection ports 108 for ejecting ink. 21-1, 21-2, 21-3, 21-4 and 21-5 represent ink jet heads for black (K), print performance improving ink (P), cyan (C), magenta (M) and yellow (Y).

Figure 2:
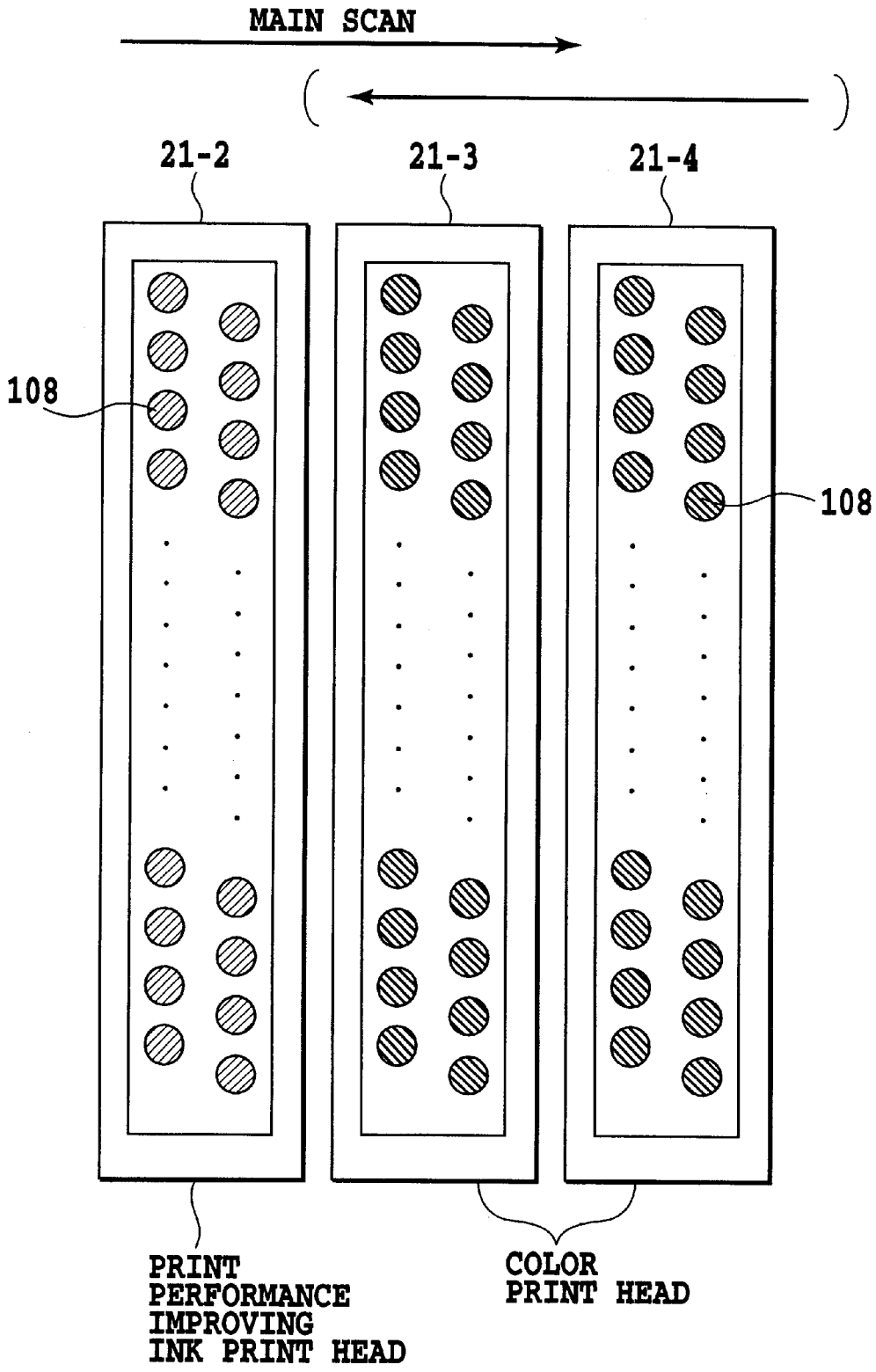
FIG. 2 is a conceptual diagram showing an arrangement of ink ejection ports in ink jet print heads.

As shown in FIG. 2, the print head 21-2 for ejecting print performance improving ink (P) has 32 ink ejection ports 108 arranged in two columns staggered from each other. That is, each of the ink ejection ports 108 in one column is located between the adjacent ink ejection ports 108 in the other column. Similar arrangement is made for the color ink print head 21-1, 21-3, . . . , with 32 ink ejection ports 108 arranged in two staggered columns. Inside the ink ejection ports (liquid paths) in each print head 21 are provided heating elements (electrothermal energy transducers) that generate thermal energy for ejecting ink.

An ink cartridge 21 comprises print heads 21-1 to 21-5 and ink tanks 22-1 to 22-5 for supplying ink to the heads.

A control signal to the ink jet heads 21 is applied through a flexible cable 23. A print medium 24, such as plain paper, high quality dedicated paper, OHP sheets, glossy paper, glossy films and post cards, are fed by feed rollers not shown and held and transported in a direction of arrow (sub-scan direction) as a transport motor 26 is driven.

The carriage 20 is supported on guide shafts 27 so that it can be moved along the guide shafts 27. The carriage 20 is reciprocated in the main scan direction along the guide shafts 27 by a carriage motor 30 through a drive belt 29. Along the guide shafts 27 is installed a linear encoder 28. At the read timing of the linear encoder 28 the heating elements of each print head 21 are driven according to the image data to eject ink droplets onto the print medium, with the ink droplets adhering to the print medium to form an image.

At a home position of the carriage 20 set outside the printing area, a recovery unit 32 having a cap portion 31 is installed. When printing is not performed, the carriage 20 is moved to the home position where caps 31-1 to 31-5 of the cap portion 31 hermetically cover a face of the ink ejection ports of each ink jet head 21 to prevent clogging of the ink ejection ports which may otherwise be caused by an evaporation of ink solvent and a resulting increase in viscosity or by adhering foreign matters such as dust.

The capping function of the capping portion 31 is used to perform a recovering ejection by which ink is ejected from the ink ejection ports into the cap portion to eliminate improper ejection or clogging of those ink ejection ports that are used only infrequently, or to perform a recovering evacuation by which a pump not shown is operated with the ejection ports capped to evacuate ink from the ink ejection ports by suction to recover the failed ejection ports to normal condition.

When each of the ink jet heads 21-1 to 21-5 passes over an ink receiving portion (not shown) just before the start of printing, the ink jet head performs a preliminary ink ejection toward the ink receiving portion. A wiping member (not shown) such as a blade is installed at a position adjacent to the cap portion 31 so that it can wipe clean the face of the ink ejection ports of each ink jet head 21.

Figure 3:
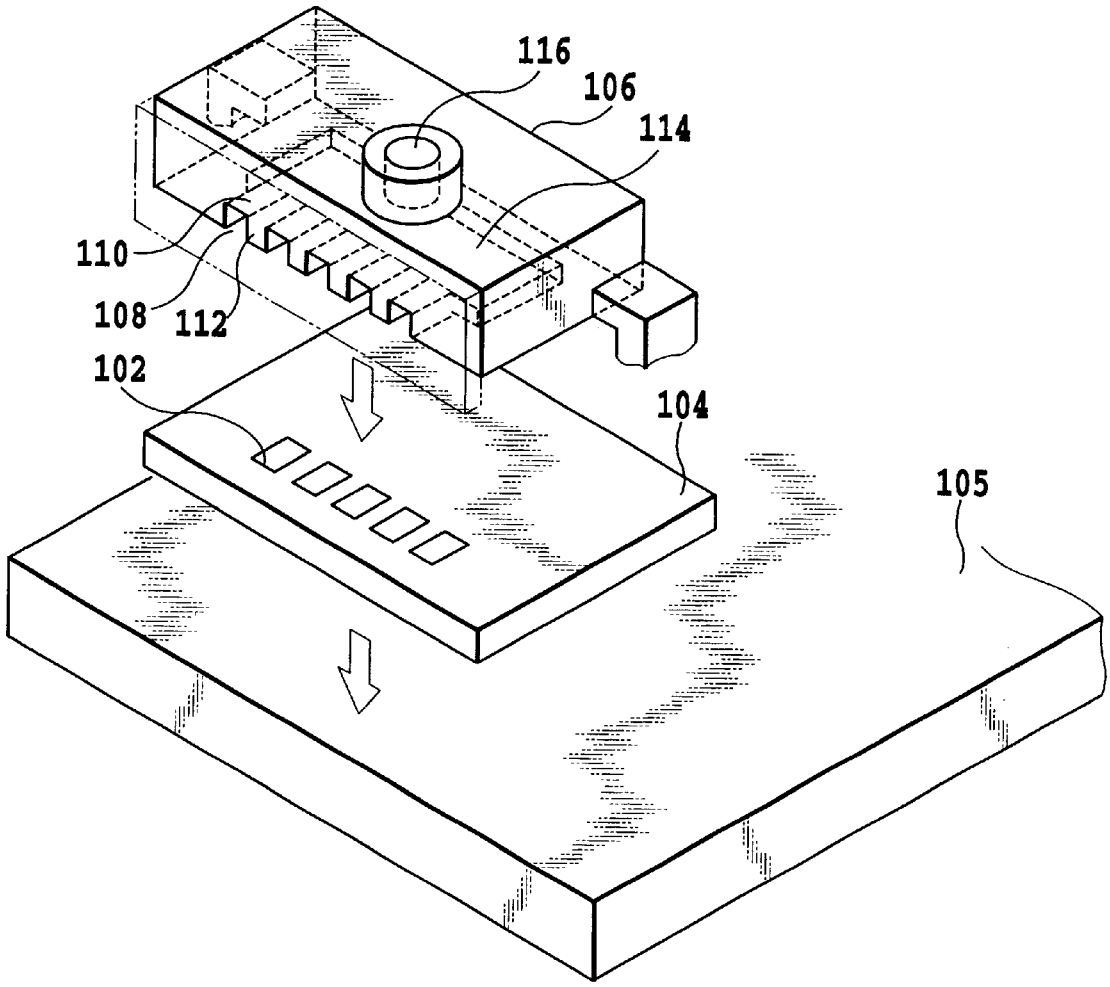
FIG. 3 is an exploded perspective view showing the construction of an ink jet print head.

FIG. 3 shows the construction of the print head 21.

In FIG. 3, the print head 21 roughly comprises a heater board 104 formed with a plurality of heaters 102 to heat ink, a top plate 106 placed on the heater board 104, and a base plate 105 supporting the heater board 104.

The top plate 106 is formed with a plurality of ink ejection ports 108, behind each of which is formed a tunnel-like liquid path 110 communicating with the corresponding ink ejection port 108. Each liquid path 110 is isolated from the adjacent liquid path by a separation wall 112. The liquid paths 110 are commonly connected at their rear end to one ink chamber 114, which is supplied with ink through an ink supply port 116. Ink is supplied from the ink chamber 114 to the individual liquid paths 110. The heater board 104 and the top plate 106 are aligned and assembled so that the heaters 102 match the corresponding liquid paths 110.

When a predetermined drive pulse is applied to the heater 102, the ink over the heater 102 boils to form a bubble, whose volume expansion pushes out an ink droplet from the ink ejection port 108.

The ink jet printing system applicable to this invention is not limited to the bubble jet (BJ) system using a heating element (heater) shown in FIG. 3. In a continuous type ink jet printing apparatus which continuously ejects ink droplets and atomizes them, this invention can also be applied to a charge control type and a dispersion control type. Further, in the on-demand type ink jet printing apparatus that ejects ink droplets as required, this invention can also be applied to a pressure control type which ejects ink droplets from orifices by mechanical vibrations of piezoelectric elements.

Figure 4:
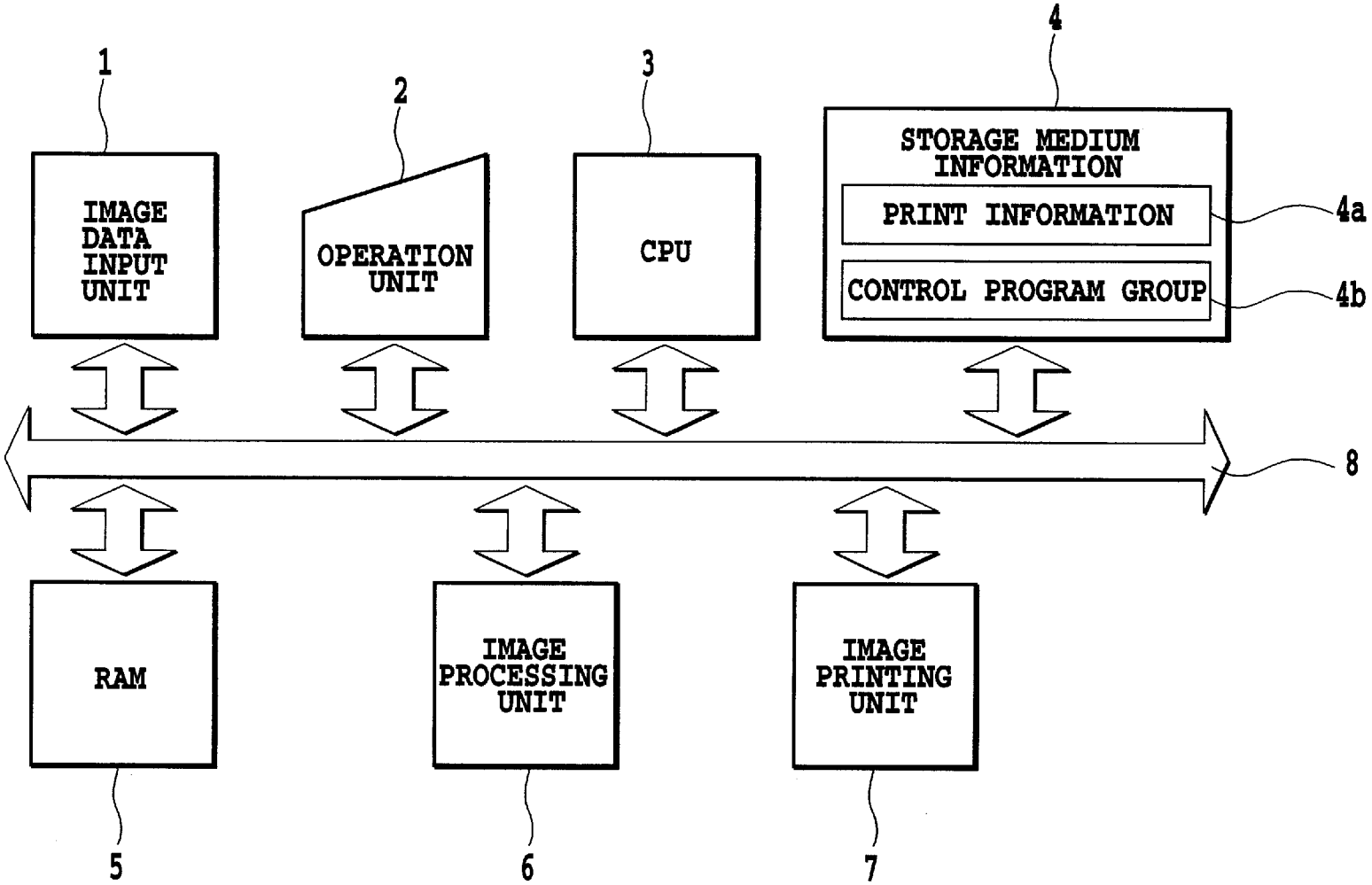
FIG. 4 is a block diagram showing an example configuration of a control system in the ink jet printing apparatus.

FIG. 4 is a block diagram showing an example configuration of a control system of the ink jet printing apparatus.

In FIG. 4, reference number 1 represents an image data input unit, 2 an operation unit, 3 a CPU for executing various processing, 4 a storage medium for storing a variety of data, 4*a* a print data storage memory for storing non-ejecting and faulty nozzle data and print data of a print performance improving ink print head, 4*b* a control program storage memory for storing a group of control programs, 5 a RAM, 6 an image processing unit, 7 an image printing unit (printer) for outputting an image, and 8 a bus having a bus line for transmitting address signals, data, control signals and others.

Entered into the image data input unit 1 are multivalued image data from image input devices such as scanner and digital camera and multivalued image data stored in hard disks of personal computers. The operation unit 2 has a variety of keys to set a variety of parameters and specify the start of printing. The CPU 3 controls the printing apparatus as a whole according to a variety of programs in the storage medium.

The storage medium 4 stores programs, such as control program and error processing program, according to which the printing apparatus is operated. The operations of this embodiment are all based on these programs. The storage medium 4 storing the programs may be a ROM, FD, CD-ROM, HD, memory card and magnetooptical disk.

A RAM 5 is used as a work area by various programs stored in the storage medium 4, as a temporary save area during the error processing, and as a work area during the image processing. The RAM 5 is also used for copying various tables from the storage medium 4, modifying the content of the tables and referencing the modified tables during the image processing.

The image data processing unit 6 separates the input multivalued image data into component colors of the associated color print heads and transforms the color-separated gray image into binary values by using an gray scale processing method such as an error spreading method and a dither matrix method.

The image printing unit 7 ejects ink according to an ejection pattern generated by the image data processing unit 6 to form a dot image on the print medium.

Next, a process of forming printed dots will be explained by referring to FIGS. 5A to 5C.

In this ink jet printing apparatus, pixels are formed by two kinds of dots, those from a color ink containing a colorant and those from the print performance improving ink.

In the following description, it is assumed that the print performance improving ink contains a cationic substance of low molecular component and high molecular component and that the color ink contains an anionic dye or at least an anionic compound and pigment. When the print performance improving ink and the color ink mix together on the print medium or in the print medium after penetrating into it, a low molecular component or cationic oligomer of the cationic substance contained in the print performance improving ink and a water-soluble dye having anionic group or an anionic pigment ink used in the color ink combine together through ionic interaction and instantly isolate from a solution phase. As a result, the pigment ink undergoes dispersive destruction to form coagulated pigments.

Figure 5A:
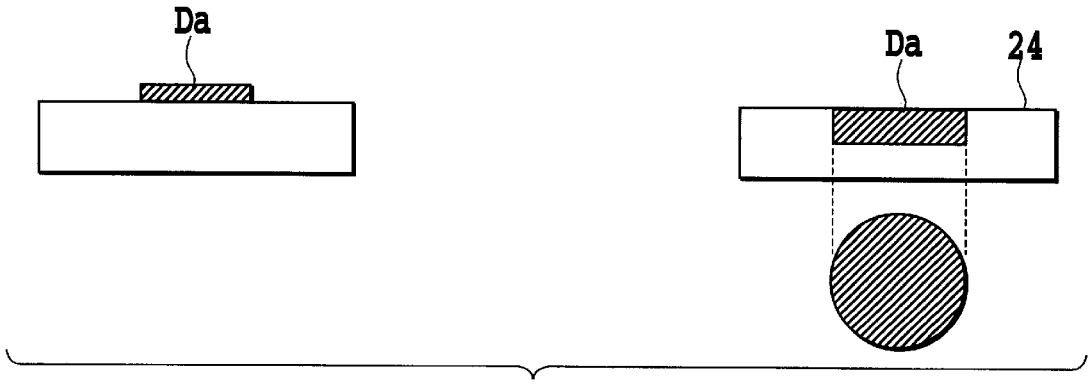
FIGS. 5A, 5B and 5C are schematic views showing states of a color ink and a print performance improving ink on a print medium.

As shown in FIG. 5A, when only a color ink droplet Da lands on the print medium 24, the ink droplet spreads horizontally in a surface layer of the print medium and seeps vertically into the medium to form an ink dot.

Figure 5B:
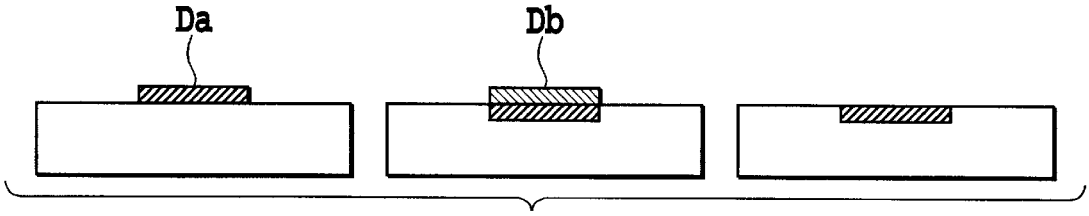
Figure 5C:
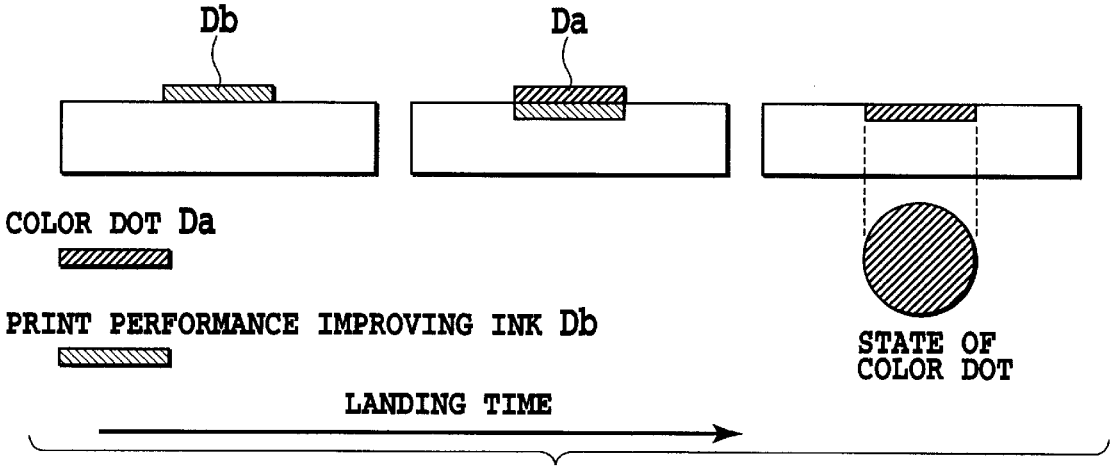

On the other hand, when the print performance improving ink droplet Db is landed on the print medium before or after or simultaneously with the color dot Da, as shown in FIGS. 5B and 5C, the color ink droplet adheres to the surface layer of the print medium 24 at a shallower depth than when only the color ink is used, in the form of a coagulated colorant, thus forming a clearly defined ink dot.

When a color ink droplet and a print performance improving ink droplet are landed with an increased time difference therebetween, the clear dot, which was produced by the coagulated colorant in the surface layer of the print medium 24, becomes difficult to form. The on-the-print-medium landing time difference between the color ink and the print performance improving ink should preferably be 2000 msec or less.

Next, the characteristic part of this invention will be explained by referring to the flow chart of FIG. 6.

First, non-ejecting nozzles and faulty nozzles (these nozzles are referred to as abnormal nozzles or abnormal ink ejection ports) in a plurality of color ink print heads 21-1, 21-3, 21-4, 21-5 are detected. Here, the non-ejecting nozzles denote those nozzles which are clogged with highly viscous ink or solidified ink after evaporation or whose ink ejection elements are damaged and fail to eject ink. The faulty nozzles denote those nozzles whose ejection performance is significantly degraded from the normal nozzles due to some anomalies. The ejection performance degradations include those in which ink is not ejected in a normal direction and in which the amount of an ink droplet significantly differs from the intended amount.

Figure 6:
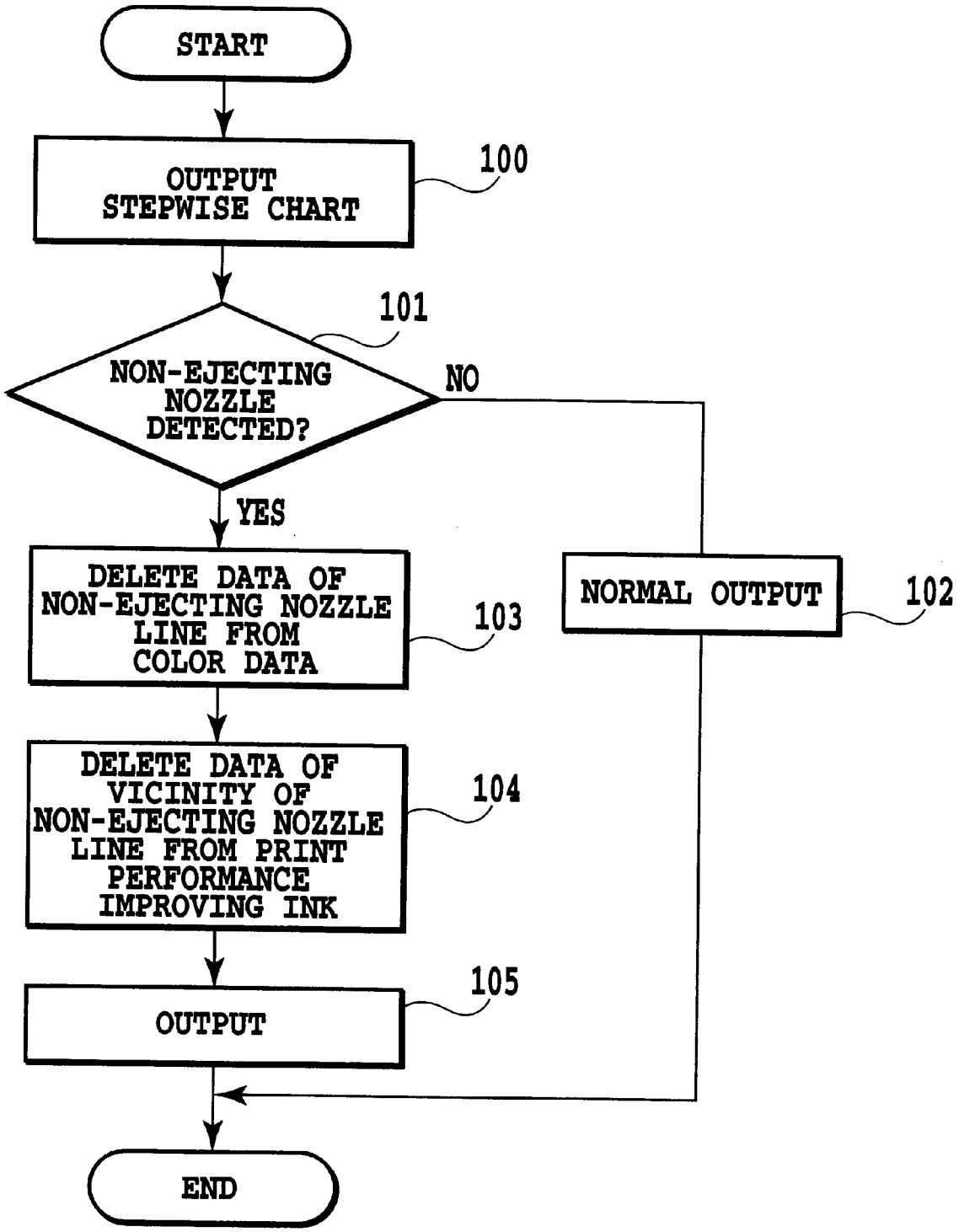
FIG. 6 is a flow chart showing a sequence of operations performed by the ink jet printing method according to this invention.
Figure 7A:
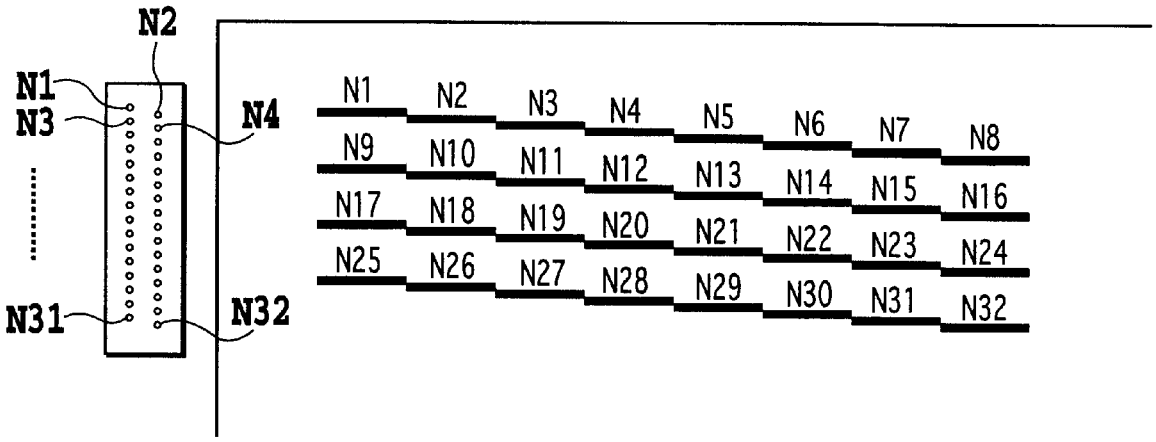
FIGS. 7A and 7B are diagrams showing an example stepped chart used to detect non-ejecting or faulty nozzles.
Figure 7B:
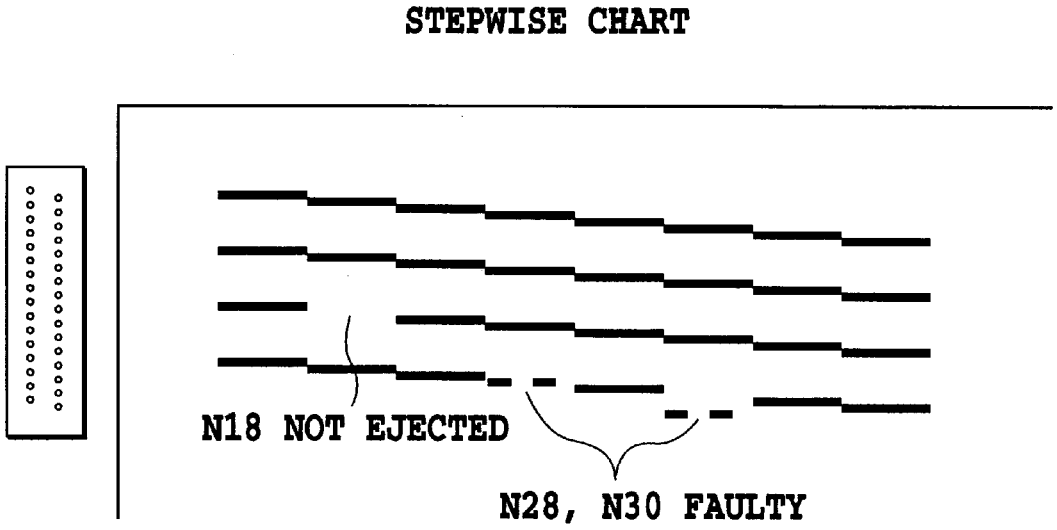

To detect abnormal nozzles, the print heads 21-1, 21-3, 21-4, 21-5 for color inks are driven to print a stepwise print pattern on the print medium 24 as shown in FIGS. 7A and 7B (step 100 of FIG. 6).

The stepwise pattern of FIGS. 7A and 7B are formed by ejecting a color ink continuously or non-continuously for eight nozzles each in a row to print stepwise short lines. When there are no abnormal nozzles, the stepwise patterns can be printed completely as shown in FIG. 7A. FIG. 7B is a stepwise pattern indicating that a non-ejecting trouble occurs with a 18th nozzle N18 and an improper or faulty ejection occurs with a 28th nozzle N28 and a 30th nozzle N30. The lines of dots printed by the non-ejecting or faulty nozzles are lost partly or entirely and they can be distinguished easily.

The printed stepwise chart is scanned by a scanning sensor, not shown, mounted on the printing apparatus and the data thus read in is subjected to recognition processing to determine which nozzle is abnormal (step 101 of FIG. 6). Alternatively, the printed chart may be visually checked without using the scanning sensor to generate non-ejecting/faulty nozzle data which is then input to the printing apparatus.

Based on the non-ejecting/faulty nozzle data for each color print head detected in this way, abnormal nozzle data is generated. The abnormal nozzle data is used to identify the non-ejecting/faulty nozzles from a plurality of nozzles. The generated abnormal nozzle data is stored in memory in the apparatus for each color print head. In the case of FIG. 7B, the abnormal nozzle data identifies nozzles N18, N28, N30 as abnormal nozzles.

When no abnormal nozzles are detected as a result of the abnormal nozzle detection process (step 101), the normal print output control is executed (step 102 of FIG. 6).

When abnormal nozzles are detected as a result of the abnormal nozzle detection process, the nozzle drive data for each color print head is corrected according to the generated abnormal nozzle data (step 103). More specifically, the scan line data corresponding to the abnormal nozzle is eliminated from the nozzle drive data for each color print head, i.e., the corresponding scan line data is changed to non-ejection data ("0"). This may be achieved either by turning off the associated print data or electrically masking a signal to the abnormal nozzle.

Next, based on the abnormal nozzle data, the nozzle drive data for the print head 21-2 of the print performance improving ink is corrected (step 104). More specifically, among the nozzle drive data for the print performance improving ink print head, data of a scan line corresponding to the abnormal nozzle and of other scan lines in the vicinity of that scan line are changed to no-ejection data (off). This can be achieved either by turning off the associated print data or electrically masking signals to the non-ejecting nozzle and neighboring nozzles, as described above.

By driving the print heads according to the nozzle drive data thus modified, an image is formed on the print medium 24 (step 105).

Now, the processing of steps 103 and 104 will be explained in more concrete terms.

In this specification, a dot position denotes a position where a dot is to be printed irrespective of whether or not a dot is actually printed.

(First Embodiment)

In the following embodiment, nozzle drive data for the print performance improving ink is generated based on the nozzle drive data for a black ink head. The amount of each print performance improving ink droplet can be increased or decreased according to the printing condition of the black head, for example increasing the amount of print performance improving ink droplet when the black head has too large a deviation in the ink ejection direction, in order to ensure that the dots printed by the black head and the dots of the print performance improving ink are closer together, thus bringing the print performance improving ink into contact with the black ink reliably.

In the first embodiment, it is assumed that the dots printed by the black head agrees in position with the dots of the print performance improving ink.

Figure 8A:
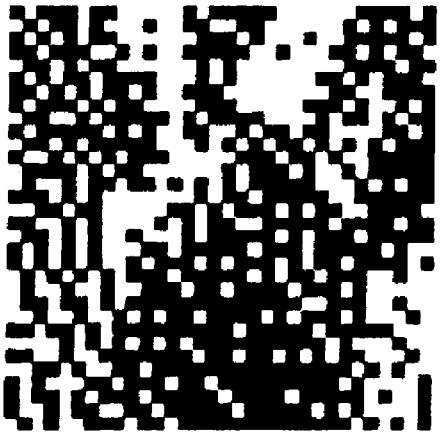
FIGS. 8A and 8B are conceptual diagrams showing print data of a color ink and a print performance improving ink when there are no non-ejecting nozzles.
Figure 8B:
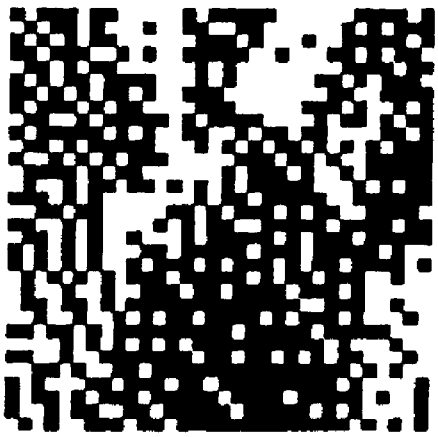

FIG. 8A represents a printed image corresponding to the black ink print data when there is no abnormal nozzle. FIG. 8B represents print data of print performance improving ink associated with the black ink print data. In this case, because there is no abnormal nozzle, both of these print data agree.

Figure 9A:
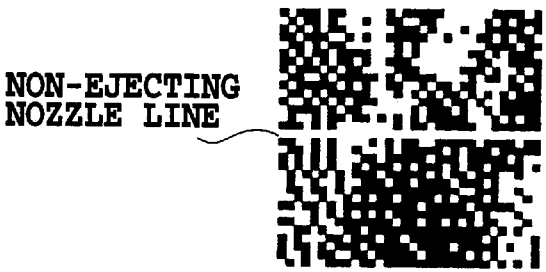
FIGS. 9A, 9B and 9C are conceptual diagrams showing print data of a color ink and a print performance improving ink before and after correction processing when there are non-ejecting nozzles.
Figure 9B:
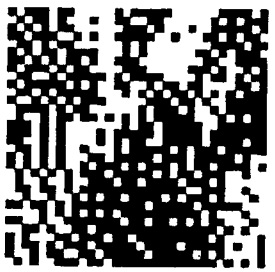
Figure 9C:
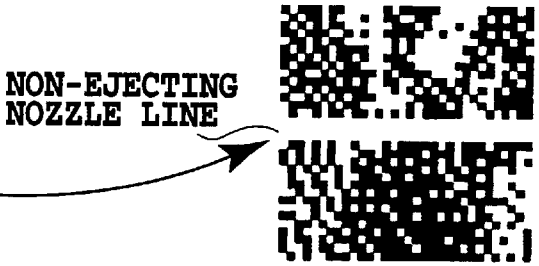

FIG. 9A shows black ink print data when there is a non-ejecting nozzle and a blank line representing the non-ejecting nozzle is seen. FIG. 9B is a print data of the print performance improving ink before correction and it is seen that ejection data exists even on a line corresponding to the non-ejecting nozzle line. FIG. 9C shows print data of the print performance improving ink after correction and it is seen that print data for a line corresponding to the non-ejecting nozzle line and for lines immediately preceding and following that line are eliminated.

When an Nth nozzle in the black head is detected as a non-ejecting nozzle, for example, a print signal to the Nth nozzle in the black head is turned off (no ejection). Further, a print signal to a nozzle in the print performance improving ink print head 21-2 that corresponds to the non-ejecting Nth nozzle and print signals to nozzles in the print performance improving ink print head immediately preceding and following that non-ejecting nozzle are turned off (no ejection).

Figure 10A:
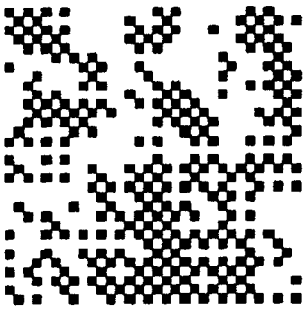
FIGS. 10A, 10B, 10C and 10D are conceptual diagrams showing print data of a color ink and a print performance improving ink after the correction processing when there are non-ejecting nozzles during a multipass printing.
Figure 10B:
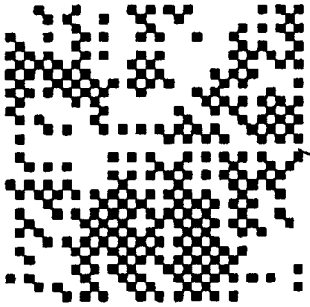
Figure 10C:
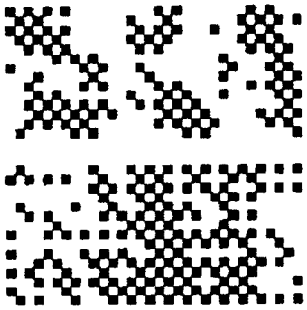
Figure 10D:
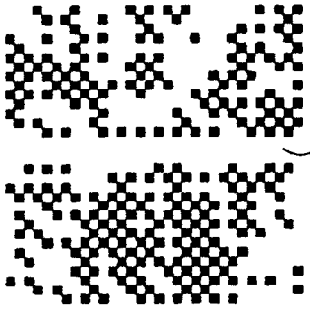

FIG. 10A shows print data for a first pass in two-pass printing when there is a non-ejecting nozzle. FIG. 10B shows print data for a second pass in which a non-ejection nozzle line is formed. FIG. 10C shows print data of print performance improving ink for a first pass after a necessary correction is made and it is seen that print data for a line corresponding to the non-ejecting nozzle line and for lines immediately preceding and following that line are eliminated. FIG. 10D shows print data of print performance improving ink for a second pass after the correction process, and it is seen that print data for a line corresponding to the non-ejecting nozzle line and for lines immediately preceding and following that line are eliminated.

That is, in the two-pass printing, although a blank line in an image produced by a non-ejecting nozzle in the first pass may be printed in the second pass by other nozzles complementing that blank line, it is difficult to eliminate that blank line in the image if a nozzle passing over that blank line in the second pass is also a non-ejecting nozzle. Therefore, in a multipass printing, too, the print performance improving ink is not ejected on a line corresponding to the non-ejecting nozzle line and on those lines directly before and after that line, as shown in FIGS. 10A to 10D.

In the multipass printing, as the landing time difference between the color dot and the corresponding print performance improving ink dot increases, it becomes difficult to form a clearly defined dot. Thus, for the same printed dot or pixel, the color dot and the print performance improving ink dot are ejected in the same pass.

In the first embodiment above, the color ink dot and the print performance improving ink dot are made to agree in position and print data. It is also possible as required to print the print performance improving ink uniformly at a predetermined density or to perform appropriate processing on the print data of the color ink and increase or decrease the print data of the print performance improving ink. What is required is to print the print performance improving ink as close to the color dot as possible to improve the printing performance. In either case, the print performance improving ink is not ejected on a line corresponding to a scan line of a non-ejecting/faulty nozzle and on lines corresponding to scan lines immediately before and after that line. This allows ink dots near the non-ejecting/faulty nozzle line to spread, making the blank line undistinguishable.

(Second Embodiment)

Next, a second embodiment of this invention will be described by referring to FIGS. 11A, 11B and FIGS. 12A to 12N.

In the second embodiment, a print head 21 is used which ejects ink droplets each measuring 8.5±0.5 pl at a resolution of 600 dpi.

The compositions of the color inks containing colorants and the composition of the print performance improving ink are as follows.

| | |
|---|---|
| (Yellow Ink) | |
| Glycerine | 5.0 wt % |
| Thiodiglycol | 5.0 wt % |
| Urea | 5.0 wt % |
| Isopropyl alcohol | 4.0 wt % |
| Dystuff, C.I. Direct Yellow 142 | 2.0 wt % |
| Water | 79.0 wt % |
| (Magenta Ink) | |
| Glycerine | 5.0 wt % |
| Thiodiglycol | 5.0 wt % |
| Urea | 5.0 wt % |
| Isopropyl alcohol | 4.0 wt % |
| Dystuff, C.I. Acid Red 289 | 2.5 wt % |
| Water | 78.5 wt % |
| (Cyan Ink) | |
| Glycerine | 5.0 wt % |
| Thiodiglycol | 5.0 wt % |
| Urea | 5.0 wt % |
| Isopropyl alcohol | 4.0 wt % |
| Dystuff, C.I. Direct Blue 199 | 2.5 wt % |
| Water | 78.5 wt % |
| (Black Ink) | |
| Glycerine | 5.0 wt % |
| Thiodiglycol | 5.0 wt % |
| Urea | 5.0 wt % |
| Isopropyl alcohol | 4.0 wt % |
| Dystuff, Food Black 2 | 3.0 wt % |
| Water | 78.0 wt % |
| (Print Performance Improving Ink) | |
| Polyarylamine hydrochloride | 5.0 wt % |
| Benzalkonium chloride | 1.0 wt % |
| Diethylene glycol | 10.0 wt % |
| Water | 83.9 wt % |

The print medium used was PB-Paper (Canon) for electrophotographic and ink jet printing.

Figure 11A:
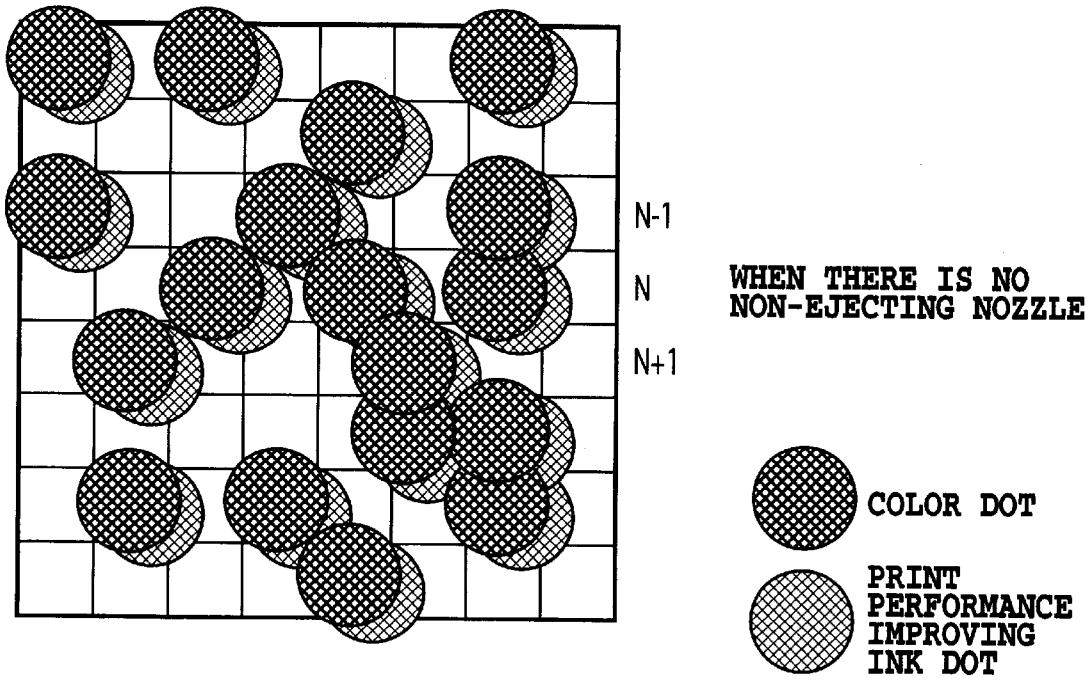
FIGS. 11A and 11B are diagrams showing dot arrangements of a color ink and a print performance improving ink before and after the correction processing according to a second embodiment of the invention.
Figure 11B:
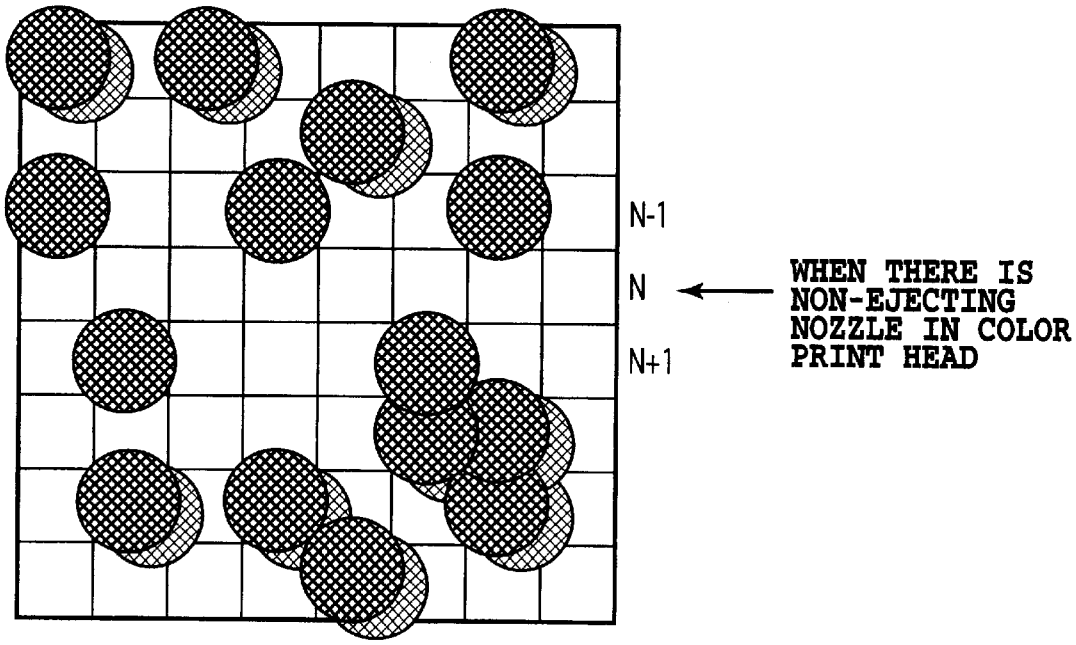

In the second embodiment, a dot matrix of the print performance improving ink is printed shifted ⅙ pixel (e.g., ¼ pixel or ½ pixel) from that of the corresponding color ink, as shown in FIGS. 11A and 11B. In the case of FIGS. 11A and 11B, the dots of the print performance improving ink are printed deviated to the lower right in the figure by ¼ pixel from the corresponding dots of the color ink. This can be realized easily as by shifting the color print head and the print performance improving ink print head from each other by a predetermined distance when fixing them to the carriage.

With the dot positions of the print performance improving ink shifted from the corresponding dot positions of the color ink as described above, it is possible to allow the color dots to spread or broaden out to the dot positions of the non-ejecting nozzles.

The processing of steps 103 and 104 of FIG. 6 in the second embodiment will be described in more concrete terms by referring to FIGS. 12A to 12N.

FIG. 12A schematically shows digitized image data, before being corrected, which is to be printed by a print performance improving ink print head having 32 nozzles (ink ejection ports) and which spans six columns of 32 dots (pixels) each (Mth to (M+5)th columns) in the main scan direction. A black solid pixel represents a dot of image data "1"and a blank pixel represents a dot of image data "0".

FIG. 12B schematically shows digitized image data to be printed by a color print head having 32 nozzles and which spans six columns of 32 dots each (Mth to (M+5)th columns) in the main scan direction. In this case, it is assumed that the color print head and the print performance improving ink print head are given the same image data (nozzle drive data).

Suppose that an Nth nozzle in the color print head (in this case N=16) is a non-ejecting nozzle, as shown in FIG. 12B.

Because the Nth nozzle in the color print head (N=16) is a non-ejecting nozzle, the image data to be given to the color print head which ranges from Mth column to (M+5)th column is corrected to set Nth nozzle print data to "0" (no ejection) regardless of whether the original image data at the corresponding pixels are "0" or "1", as shown in FIGS. 12C, 12E, 12G, 12I, 12K and 12M.

As for the image data to be given to the print performance improving ink print head which ranges from Mth column to (M+5)th column, (N−1)st, Nth and (N+1)st nozzle print data are corrected to "0" regardless of whether the original image data at the corresponding pixels are "0" or "1" (see FIGS. 12D, 12F, 12H, 12J, 12L and 12N).

That is, in the Mth column image data to the color print head, there are no image data for (N−1)st and (N+1)st nozzles, as shown in FIG. 12C. Hence, in the Mth column image data to the print performance improving ink print head 21-2, print data for (N−1)st and (N+1)st nozzles are left unchanged at "0", as shown in FIG. 12D. Although print performance improving ink print data for Nth nozzle is "1", it is changed to "0".

Next, in the (M+1)st column image data to the color print head, there are no image data for (N−1)st, Nth and (N+1)st nozzles, as shown in FIG. 12E. Hence, in the (M+1)st column image data to the print performance improving ink print head 21-2, print data for (N−1)st, Nth and (N+1)st nozzles are left unchanged at "0", as shown in FIG. 12F.

In the (M+2)nd column image data to the color print head, there are image data for (N−1)st and Nth nozzles, as shown in FIG. 12G. Hence, in the (M+2)nd column image data to the print performance improving ink print head 21-2, print data for (N−1)st and Nth nozzles are corrected to "0", as shown in FIG. 12H. Print data for (N+1)st nozzle is left unchanged at "0".

Next, in the (M+3)rd column image data to the color print head, there is image data for (N+1)st nozzle, as shown in FIG. 12I. Hence, in the (M+3)rd column image data to the print performance improving ink print head 21-2, print data for (N+1) nozzle is corrected to "0", as shown in FIG. 12J. Print data for (N−1)st and Nth nozzles are left unchanged at "0".

Next, in the (M+4)th column image data to the color print head, there is image data for (N−1)st nozzle, as shown in FIG. 12K. Hence, in the (M+4)th column image data to the print performance improving ink print head 21-2, print data for (N−1) nozzle is corrected to "0", as shown in FIG. 12J. Print data for Nth and (N+1)st nozzles are left unchanged at "0".

Next, in the (M+5)th column image data to the color print head, there are image data for (N−1)st, Nth and (N+1)st nozzles, as shown in FIG. 12M. Hence, in the (M+5)th column image data to the print performance improving ink print head 21-2, print data for (N−1)st, Nth and (N+1)st nozzles are corrected to "0", as shown in FIG. 12N.

In this way, the similar processing continues to be carried out for the entire image data by printing dots with the color ink and the print performance improving ink.

FIG. 11B shows printed dots according to the color dot print data and the print performance improving ink print data after being corrected in the second embodiment when an Nth nozzle in the color print head fails to eject ink.

As can be seen from this figure, color ink dots are not formed on the line in which the ejection failure has occurred. It is also noted that the print performance improving ink dots are not formed on the line in which the ejection failure has occurred and on those lines immediately preceding and following that line.

(Third Embodiment)

Next, a third embodiment of this invention will be described by referring to FIGS. 13A, 13B and FIGS. 14A to 14L.

In the preceding second embodiment, the print performance improving ink is not ejected on the abnormal nozzle line and on two adjoining lines, one each immediately before and after the abnormal nozzle line. In the third embodiment, the print performance improving ink is not ejected on the abnormal nozzle line and on a total of four adjoining lines, two each immediately before and after the abnormal nozzle line.

In this embodiment, a print head 21 is used which ejects ink droplets each measuring 8.5±0.5 pl at a resolution of 600 dpi, as in the second embodiment. The compositions of a color ink containing colorant and of a print performance improving ink and a print medium are similar to those of the second embodiment.

Figure 13A:
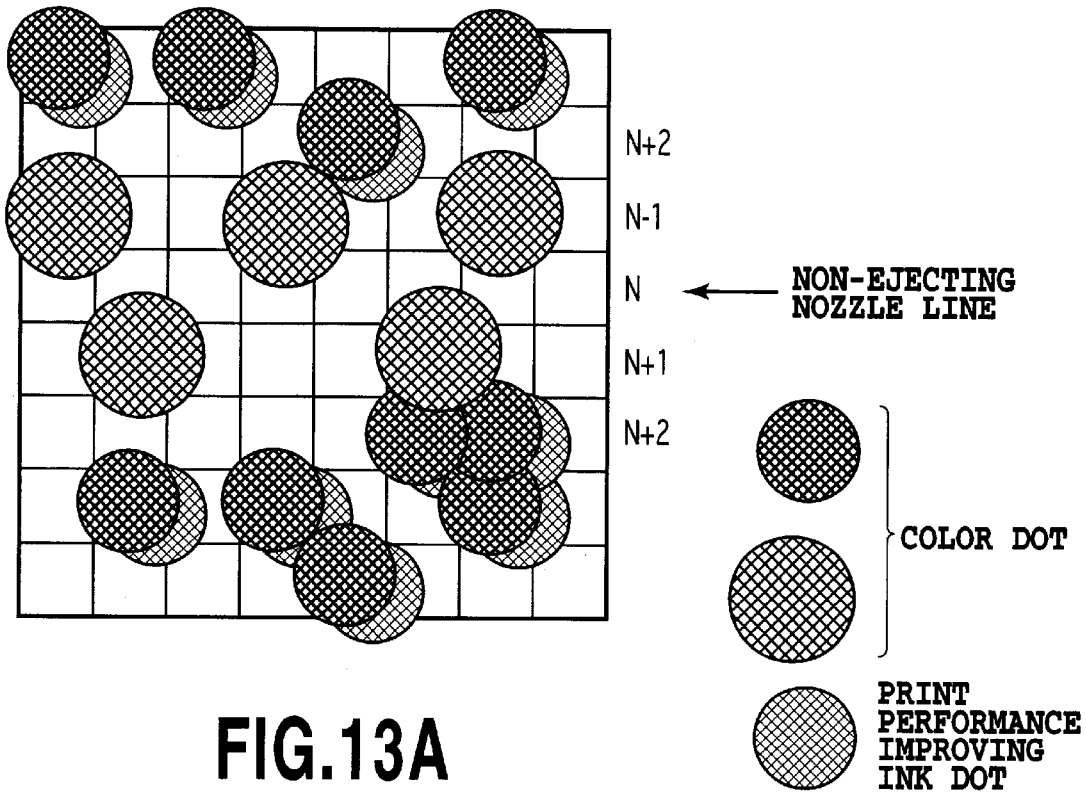
FIGS. 13A and 13B are diagrams showing dot arrangements of a color ink and a print performance improving ink before and after the correction processing according to a third embodiment of the invention.
Figure 13B:
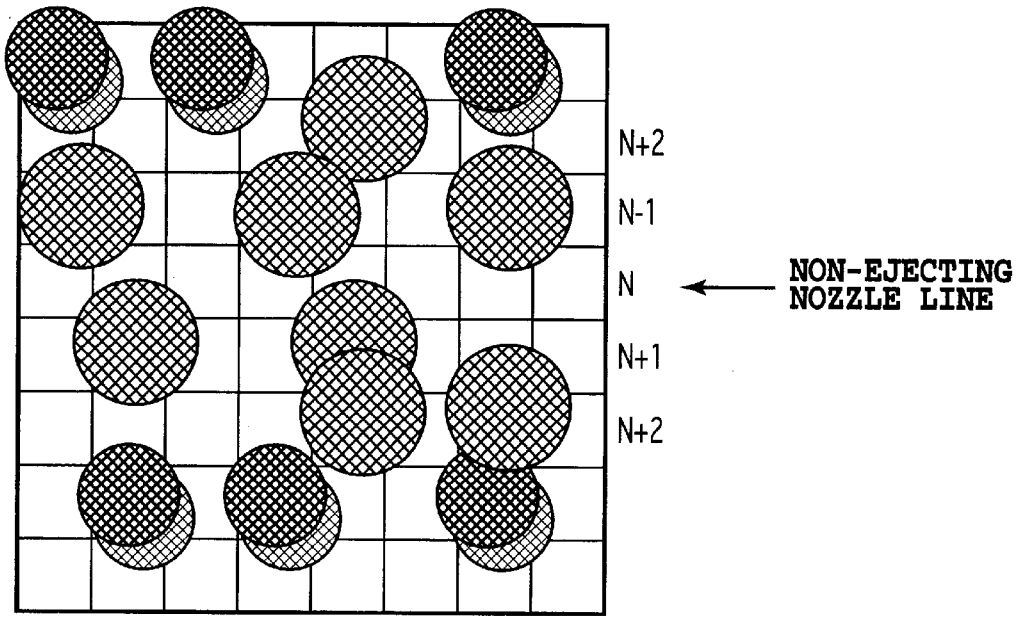

As shown in FIGS. 13A and 13B, the print performance improving ink dots are printed deviated to the lower right by ¼ pixel from the corresponding color ink (black ink) dots, as in the second embodiment. In this embodiment, too, nozzle drive data for the print performance improving ink print head is generated according to nozzle drive data for the black print head.

In this case, too, it is assumed that an Nth nozzle in the color print head (black head) (in this case N=16) is a failed nozzle.

Because an Nth nozzle in the color print head (N=16) is a non-ejecting nozzle, the image data to be given to the color print head ranging from Mth column to (M+5)th column are corrected to set Nth nozzle print data to "0" regardless of whether the original image data at the corresponding pixels are "0" or "1", as shown in FIGS. 14A, 14C, 14E, 14G, 14I and 14K.

As for the image data to be given to the print performance improving ink print head ranging from Mth column to (M+5)th column, (N−2)nd, (N−1)st, Nth, (N+1)st and (N+2)nd nozzle print data are corrected to "0" regardless of whether the original image data at the corresponding pixels are "0" or "1" (see FIGS. 14B, 14D, 14F, 14H, 14J and 14L).

That is, in the Mth column image data to the color print head, there are image data for (N−2)nd and (N+2)nd nozzles, as shown in FIG. 14A. Hence, in the Mth column image data to the print performance improving ink print head, print data for (N−2)nd and (N+2)nd nozzles are corrected to "0", as shown in FIG. 14B. Print performance improving ink print data for (N−1)st and (N+1)st nozzles are left unchanged at "0". Print data for Nth nozzle is set to "0".

Next, in the (M+1)st column image data to the color print head, there are no image data for (N−2)nd to (N+2)nd nozzles, as shown in FIG. 14C. Hence, in the (M+1)st column image data to the print performance improving ink print head, print data for (N−2)nd to (N+2)nd nozzles are left unchanged at "0", as shown in FIG. 14D.

Next, in the (M+2)nd column image data to the color print head, there are image data for (N−2)nd and (N−1)st nozzles and no image data for (N+1)st and (N+2)nd nozzles as shown in FIG. 14E. Hence, in the (M+2)nd column image data to the print performance improving ink print head, print data for (N−2)nd and (N−1)st nozzles are corrected to "0" and print data for (N+1)st and (N+2)nd nozzles are left unchanged at "0", as shown in FIG. 14F. Print data for Nth nozzle is set to "0".

Next, in the (M+3)rd column image data to the color print head, there is image data for (N+1)st nozzle and no image data for (N−2)nd, (N−1)st and (N+2)nd nozzles, as shown in FIG. 14G. Hence, in the (M+3)rd column image data to the print performance improving ink print head, print data for (N+1) nozzle is corrected to "0" and print data for (N−2)nd, (N−1)st and (N+2)nd nozzles are left unchanged at "0", as shown in FIG. 14H. Print data for Nth nozzle is set to "0".

Next, in the (M+4)th column image data to the color print head, there are image data for (N−1)st and (N+2)nd nozzles and no image data for (N−2)nd and (N+1)st nozzles, as shown in FIG. 14I. Hence, in the (M+4)th column image data to the print performance improving ink print head, print data for (N−1) and (N+2) nozzles are corrected to "0" and print data for (N−2)nd and (N+1)st print data are left unchanged at "0", as shown in FIG. 14J. Print data for Nth nozzles is set to "0".

Next, in the (M+5)th column image data to the color print head, there are image data for (N−1)st and (N+1)st nozzles and no image data for (N−2)nd and (N+2)nd nozzles as shown in FIG. 14K. Hence, in the (M+5)th column image data to the print performance improving ink print head, print data for (N−1)st and (N+1)st nozzles are corrected to "0" and print data for (N−2)nd and (N+2)nd nozzles are left unchanged at "0", as shown in FIG. 14L. Print data for Nth nozzle is set to "0".

In this way, the similar processing continues to be carried out for the entire image data by printing dots with the color ink and the print performance improving ink.

FIG. 13B shows printed dots according to the color dot print data and the print performance improving ink print data after being corrected in the third embodiment when an Nth nozzle in the color print head (black head) fails to eject ink.

As can be seen from this figure, color ink dots are not formed on the line in which the ejection failure has occurred.

It is also noted that the print performance improving ink dots are not formed on the line in which the ejection failure has occurred and on a total of four lines, two each immediately preceding and following that line.

(Fourth Embodiment)

The techniques according to the second and third embodiments are evaluated by using three kinds of print mediums. The degree to which blank lines are inconspicuous is rated in three levels—excellent, good and fair.

Technique of second embodiment using PB-Paper: Good

Technique of third embodiment using PB-Paper: Excellent

Technique of second embodiment using HR-101: Good

Technique of third embodiment using HR-101: Good

Technique of second embodiment using GP-101: Fair

Technique of third embodiment using GP-101: Good

It is seen from the above result that differentiating the mode of application of the print performance improving ink, such as the number of lines to which the print performance improving ink is not applied, according to the kind of the print medium can optimally prevent the forming of blank lines on a particular print medium.

Another experiment was also performed in which, after the print performance improving ink was printed, a color print head having a failed nozzle performed printing during another scanning. The difference in dot landing time on the print medium between the print performance improving ink and the color ink was 2 seconds. In this case, advantageous effects produced in the preceding embodiments are not observed and no improvements are made on the image quality degradation due to blank lines.

In this invention the print performance improving ink may be colorless and clear, or colored. As described above, when a color dot and a print performance improving ink dot contact each other, the colorant instantly coagulates on the print medium. Hence, a desired effect cannot be expected when the color dot and the adjoining print performance improving ink dot are printed a sufficiently long interval apart. It is therefore preferred that the color ink and the print performance improving ink be brought into contact with each other before one of the inks is absorbed sufficiently into the print medium.

Further, because it is considered desirable that the print performance improving ink and the color dot be mixed together positively on the print medium, it is preferred that the interval between their landing times be further shortened. As for the order of printing, the print performance improving ink may first be printed, followed by the color ink, or vice versa. In either case, the landing intervals between these two inks should be such that one of the two inks is ejected well before the other ink that has landed first is completely soaked into the print medium or dried.

While in the above embodiment the sizes of dot matrices of the color dots and the print performance improving ink dots are set equal, they may be differentiated. That is, the output resolution of the color dots is maintained while lowering the output resolution of the print performance improving ink dots. This arrangement can reduce cost involving data processing of the print performance improving ink and cost of the print performance improving ink used on the apparatus.

In this invention, because the print data of the print performance improving ink can be generated using simple image processing, the processing speed can be increased. Although it may cost slightly more, a plurality of light- and dark-colored inks or large- and small-size dots may be used for each color. In this case, the present invention can reproduce a higher order of gray scale on a print medium.

The present invention can be implemented by combining at least one kind of color ink and at least one kind of print performance improving ink. It is also possible to prepare two or more kinds of color ink and two or more kinds of print performance improving ink. In that case, the color ink or the print performance improving ink need only be landed at desired positions on the print medium while the print performance improving ink or the color ink is wet. The color ink may be of any desired color. Alternatively, the invention may be applied to a particular color ink only. In this invention, the most effective system for the inks described above is the one executing the film boiling method described above.

(Others)

While in the embodiments above we have described the construction in which a stepwise print pattern is actually printed on a print medium and checked to detect a non-ejecting or faulty nozzle, this invention can also employ other detection techniques. Further, the present invention can achieve its objective as long as an abnormal nozzle can be identified if a construction for detecting the abnormal nozzle is not provided. For example, a faulty nozzle or failed nozzle can be identified by inputting the result of user's visual check into the printing apparatus either directly or through a driver of a host apparatus connected to the printing apparatus. In a construction having a storage means such as memory installed in the print head, information on each nozzle and information on the failed/faulty nozzles may be stored in the storage means so that the printing apparatus can read these information to identify the failed/faulty nozzles. As for the timing at which such information is stored in the storage means in the print head, information on an initial state may be stored in the storage means at time of shipping or the information may be updated according to the history of use by the user.

In the ink jet printing system, the present invention produces an excellent effect when it is applied to a print head and a printing apparatus of a type which has a means for generating a thermal energy for ejecting ink (e.g., electrothermal transducers and laser beams) and which causes a status change in ink by the generated thermal energy. This type of print head and printing apparatus when applying this invention can achieve a higher density and a higher resolution.

A representative and preferred construction and working principle of this type of the ink jet printing system may be found in U.S. Pat. Nos. 4,723,129 and 4,740,796. This type of printing system is applicable to both the so-called on-demand printing and continuous printing. The on-demand printing is particularly advantageous for the following reason. An electrothermal transducer arranged in each sheet or liquid path holding a liquid (ink) is applied at least one drive signal which corresponds to print data and causes a quick temperature rise in excess of a nucleate boiling to generate a thermal energy in the electrothermal transducer which in turn causes a film boiling on a heat acting surface in the print head. As a result, a bubble can be formed in the liquid (ink) in each liquid path in one-to-one correspondence with the drive signal. The growth and contraction of this bubble ejects liquid (ink) through the nozzle opening to form at least one flying droplet. The drive signal can be more advantageously formed in a pulse shape. With a pulse drive signal the bubble can be grown and contracted instantly, realizing a liquid (ink) ejection with an excellent responsiveness. Examples of preferred pulse drive signals include those described in U.S. Pat. Nos. 4,463,359 and 4,345,262. Further improvements can be made by adopting the conditions described in U.S. Pat. No. 4,313,124 related to a rate of temperature rise on the heat acting surface.

The constructions of the print head to which the present invention can be applied include those disclosed in the above-cited specifications in which liquid ejection ports, liquid paths and electrothermal transducers are integrally combined (linear liquid paths or rectangular liquid paths) and those disclosed in U.S. Pat. Nos. 4,558,333 and 4,459,600 in which a heat acting portion is arranged in a bent area. The present invention is also effectively applicable to a construction disclosed in Japanese Patent Laid-open No. 59-123670 in which a common slit to a plurality of electrothermal transducers forms ejection portions of individual electrothermal transducers and also to a construction disclosed in Japanese Patent Laid-open No. 59-138461 in which an opening for absorbing a pressure wave of the thermal energy is formed in each ejection portion. That is, whatever the form of the print head, this invention enables reliable and efficient execution of printing.

Further, the present invention can also be applied effectively to a full-line type print head which has a length matching the maximum printable width of the print medium. Such a print head may have a construction in which the full length may be provided by a combination of a plurality of print heads or by a single integrally formed print head.

In the serial type described above, the present invention can also be advantageously applied where the print head is fixed to the printing apparatus, where the print head is of a replaceable chip type which, when mounted to the printing apparatus, can establish an electrical connection with, and receive ink from, the apparatus, or where the print head is of a cartridge type which has an integrally formed ink tank.

Adding a print head ejection performance recovery means, a preliminary auxiliary means and others to the printing apparatus of this invention is desirable because they help stabilize the advantageous effect of the invention. Examples of such additional auxiliary means for a print head include a capping means, a cleaning means, a pressurizing or suction means, a preliminary heating means using an electrothermal transducer or a separate heating element or a combination of these, and a preliminary ejection means for ejecting ink for a purpose other than printing.

As for the kind and number of print heads mounted on the printing apparatus, only one print head may be provided for a single color ink, or a plurality of print heads may be used for a plurality of inks of different colors and different density. That is, this invention is very effectively applied to a printing apparatus which has at least one of different print modes, which include a monochrome print mode using a black ink, a mainstream color, a plural color print mode using different colors and a full-color print mode utilizing color mixing, whether the print head is formed as a single integral head or as a combination of multiple heads.

Furthermore, the ink jet printing apparatus of this invention may be used an image output terminal for information processing equipment such as computers, as a copying machine in combination with a reader, and as a facsimile with a function of transmission and reception.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing method for forming an image on a print medium according to input image data by using a color ink print head and a print performance improving ink print head, the color ink print head having a plurality of ink ejection ports arrayed therein, the print performance improving ink print head having a plurality of ink ejection ports arrayed therein, and by ejecting a color ink from the color ink print head and a print performance improving ink from the print performance improving ink print head onto the print medium, wherein, in forming an image on the print medium, the print performance improving ink is not applied to a dot position corresponding to an abnormal ink ejection port among the plurality of ink ejection ports in the color ink print head which is determined to have a deteriorated ejection state, and to a vicinity of the dot position corresponding to the abnormal ink ejection port.

2. The ink jet printing method according to claim 1, wherein the print performance improving ink is not applied to a print line corresponding to the abnormal ink ejection port and to at least one line each immediately before and after the print line corresponding to the abnormal ink ejection port.

3. The ink jet printing method according to claim 2, wherein the number of lines to which the print performance improving ink is not applied is changed according to a kind of print medium.

4. The ink jet printing method according to claim 1, wherein before forming an image according to the input image data, the ink ejection port among the plurality of ink ejection ports which has a deteriorated ejection state is determined.

5. The ink jet printing method according to claim 4, wherein the abnormal ink ejection port is determined by ejecting the ink from individual ink ejection ports of the color ink print head onto a print medium to form a predetermined print pattern on the print medium and by reading the print pattern thus printed.

6. The ink jet printing method according to claim 1, wherein the print heads apply heat to the inks to form bubbles and eject the inks by the formed bubbles.

7. An ink jet printing apparatus having a color ink print head with a plurality of ink ejection ports arrayed therein to eject a color ink and a print performance improving ink print head with a plurality of ink ejection ports arrayed therein to eject a print performance improving ink, the color ink and the print performance improving ink being ejected from these print heads onto a print medium to form an image on the print medium according to input image data, comprising:

means for identifying from among the plurality of ink ejection ports in said color ink print head an abnormal ink ejection port determined to have a deteriorated ejection state; and means for controlling not to apply the print performance improving ink to a dot position corresponding to the identified abnormal ink ejection port and to a vicinity of the dot position corresponding to the abnormal ink ejection port.

8. The ink jet printing apparatus according to claim 7, wherein the control means does not apply the print performance improving ink to a print line corresponding to the identified abnormal ink ejection port and to at least one line each immediately before and after the print line corresponding to the abnormal ink ejection port.

9. The ink jet printing apparatus according to claim 8, wherein the control means changes according to a kind of print medium the number of lines to which the print performance improving ink is not applied.

10. The ink jet printing apparatus according to claim 7, further comprising decision means for determining the abnormal ink ejection port by ejecting the ink from the ink ejection ports of the color ink print head onto a print medium to form a predetermined print pattern on the print medium and by reading the print pattern thus printed.

11. The ink jet printing apparatus according to claim 7, wherein the print heads apply heat to the inks to form bubbles and eject the inks by the formed bubbles.

* * * * *